US011274894B1

(12) United States Patent
Hill et al.

(10) Patent No.: US 11,274,894 B1
(45) Date of Patent: Mar. 15, 2022

(54) ENHANCED FIRE-CONTROL SYSTEM

(71) Applicant: FREEFALL INC., Scottsdale, AZ (US)

(72) Inventors: Casey Hill, Mesa, AZ (US); Sean McElroy, Chandler, AZ (US); Rock McMillan, Cave Creek, AZ (US); Brodie Renner, Cave Creek, AZ (US); Christopher T. Dillon, Scottsdale, AZ (US)

(73) Assignee: FREEFALL INC., Scottsdale, AZ (US)

( * ) Notice: Subject to any disclaimer, the term of this patent is extended or adjusted under 35 U.S.C. 154(b) by 0 days.

(21) Appl. No.: 17/339,916

(22) Filed: Jun. 4, 2021

(51) Int. Cl.
*F41A 17/82* (2006.01)
*F41A 19/45* (2006.01)
*F41A 19/10* (2006.01)

(52) U.S. Cl.
CPC ..... *F41A 17/82* (2013.01); *F41A 19/10* (2013.01); *F41A 19/45* (2013.01)

(58) Field of Classification Search
CPC ..... F41A 17/82; F41A 17/22; F41A 17/46; F41A 17/48; F41A 17/50; F41A 17/72; F41A 19/00; F41A 19/45; F41A 19/10
USPC ..... 42/42.02, 69.01, 69.03
See application file for complete search history.

(56) References Cited

U.S. PATENT DOCUMENTS 361,100 A 4/1887 Wesson
465,764 A 12/1891 Jenkins
1,579,742 A 4/1926 Von Frommer
2,635,379 A 6/1948 Baker et al.
3,258,871 A 7/1966 Green
4,908,970 A 3/1990 Bell
5,105,569 A * 4/1992 Straitiff ..... F41A 3/02 42/2
5,560,134 A 10/1996 Van Niekerk et al.
6,354,032 B1 3/2002 Viani
6,553,706 B1 4/2003 Gancarz et al.
6,843,013 B2 1/2005 Cutini et al.
D597,626 S 8/2009 Krieger
8,220,193 B1 * 7/2012 Lynch ..... F41A 17/82 42/70.08
8,250,799 B2 8/2012 Duperry et al.
8,490,310 B2 7/2013 Tresserras Torre
8,881,442 B2 11/2014 Elftmann, Jr.
9,046,313 B1 * 6/2015 Lutton ..... F41A 19/44
9,121,654 B2 9/2015 Arnedo Vera et al.
9,341,424 B2 5/2016 Allan
9,383,153 B2 7/2016 Nebeker et al.
9,696,104 B1 7/2017 Bloomfield
9,970,723 B1 * 5/2018 Findlay ..... F41A 17/46
10,006,734 B1 * 6/2018 Findlay ..... F41A 19/12
10,030,926 B2 7/2018 Mather et al.
10,060,693 B2 8/2018 Bubits
10,156,409 B1 * 12/2018 Laney ..... F41A 19/10
(Continued)

*Primary Examiner* — John Cooper
(74) *Attorney, Agent, or Firm* — Fennemore, P.C.

(57) ABSTRACT

Disclosed herein is an enhanced fire control system for firearms having semi-automatic firing mechanisms. The system comprises a primary trigger, a secondary trigger, and a trigger stop having a stop riser. The trigger stop's stop riser limits breaking a trigger sear interface between the primary trigger and the firearm's hammer. The system is intended to reduce the risk of a firearm being unintentionally discharged as a result of the trigger being contacted with straps or other equipment the user is carrying or wearing, or as a result of contact with something in the environment.

11 Claims, 7 Drawing Sheets

(56) References Cited

U.S. PATENT DOCUMENTS

| | | | | |
|---|---|---|---|---|
| 10,247,502 | B2 | 4/2019 | Kilic | |
| 10,317,158 | B2 | 6/2019 | Geissele | |
| 10,451,371 | B2 | 10/2019 | Dichario et al. | |
| 10,767,950 | B2 * | 9/2020 | Lake | F41A 19/12 |
| 10,890,412 | B2 | 1/2021 | Corsi et al. | |
| 2010/0024273 | A1 * | 2/2010 | Duperry | F41A 19/10<br>42/69.01 |
| 2015/0330734 | A1 * | 11/2015 | Kolev | F41A 3/72<br>42/69.01 |
| 2019/0242666 | A1 * | 8/2019 | Geissele | F41A 19/10 |

* cited by examiner

ENHANCED FIRE-CONTROL SYSTEM

FIELD OF THE INVENTION

This invention relates to reducing the risk of the unintended discharge of a firearm, particularly firearms with semi-automatic hammer-fired mechanisms.

BACKGROUND OF THE INVENTION

While carrying out their duties, military and some law enforcement personnel often carry a semi-automatic pistol or rifle in their hands or on a shoulder strap, along with other pieces of equipment. Similarly, civilians may use semi-automatic pistols and rifles for recreational purposes, such as game hunting and competition target shooting. For various reasons, straps and other pieces of equipment may inadvertently get caught in the firearm's trigger or otherwise cause the trigger to be actuated or pulled, sometimes resulting in the unintended discharge (firing) of the firearm. The unintended discharge of a firearm can have numerous undesirable consequences, such as causing injury or death to the user or to others in the vicinity, as well as damaging real and personal property. In combat and law enforcement situations, even if injury or death does not result from the inadvertent discharge of the firearm, the resulting sound may alert the enemy, perpetrator or animal prey, causing various undesirable consequences.

SUMMARY OF THE INVENTION

Disclosed herein is an enhanced fire control system comprising a modular drop-in safety trigger assembly to replace an existing trigger on a firearm, particularly a firearm that has a semi-automatic firing mechanism. The system comprises a primary trigger, a secondary trigger, and a trigger stop having a stop riser. The trigger stop's stop riser limits breaking contact of a trigger sear interface between the primary trigger and the firearm's hammer. The system is intended to reduce the risk of a firearm being unintentionally discharged as a result of the trigger being contacted with straps or other equipment the user is carrying or wearing, or as a result of contact with something in the environment, such as a tree branch. The system described herein could also be used in an original firearm design, rather than as a modular drop-in trigger.

DETAILED DESCRIPTION OF THE INVENTION

Figure 1:
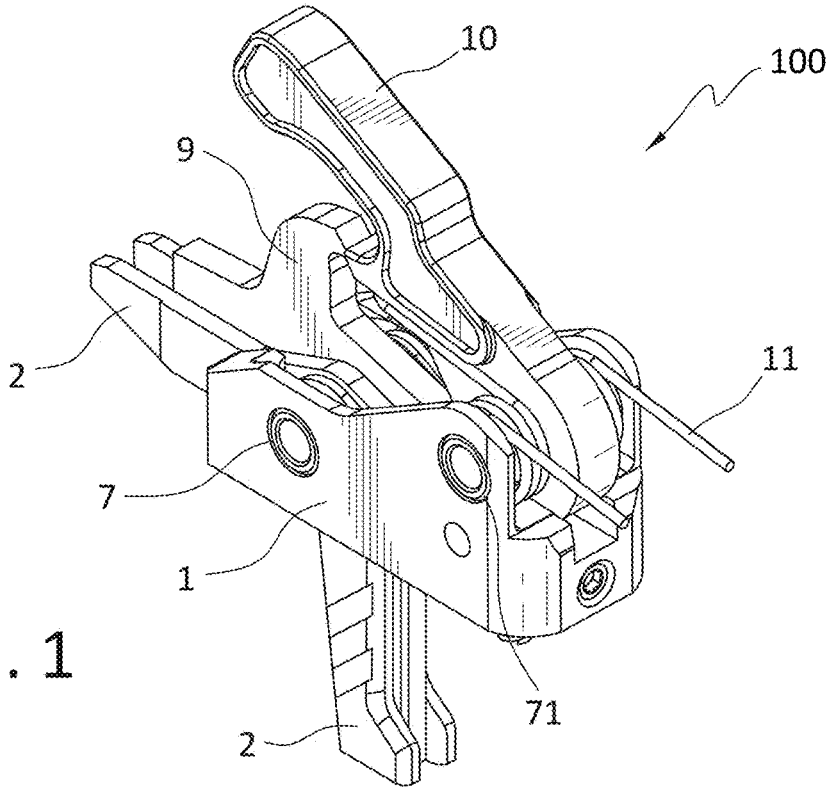
FIGS. 1-3 are, respectively, perspective, right side and left side views of the exterior of a drop-in trigger assembly comprising a fire-control system according to an embodiment of the invention.
Figure 2:
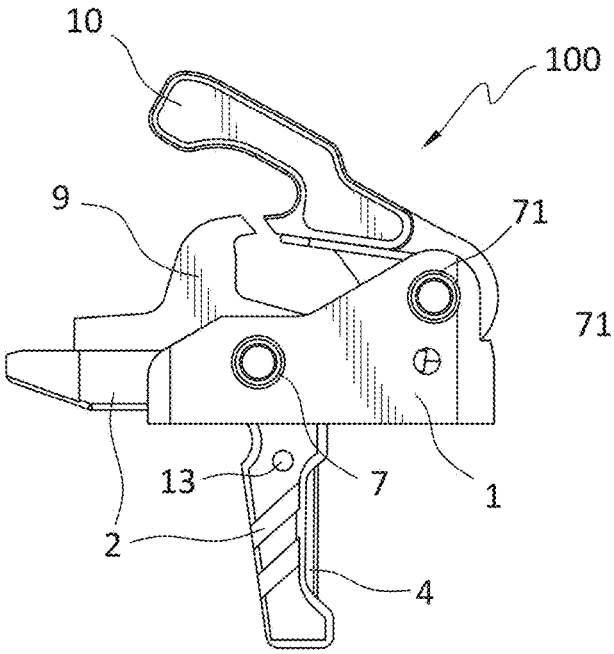
Figure 3:
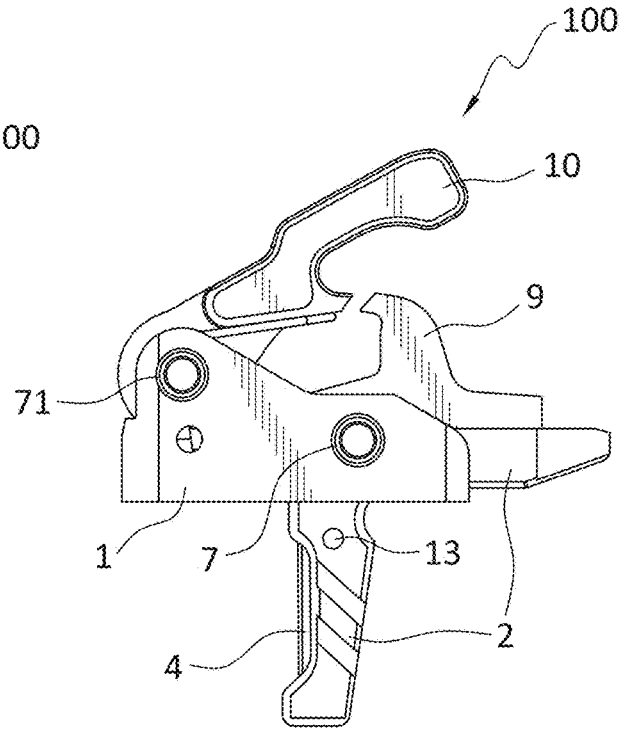
Figure 4:
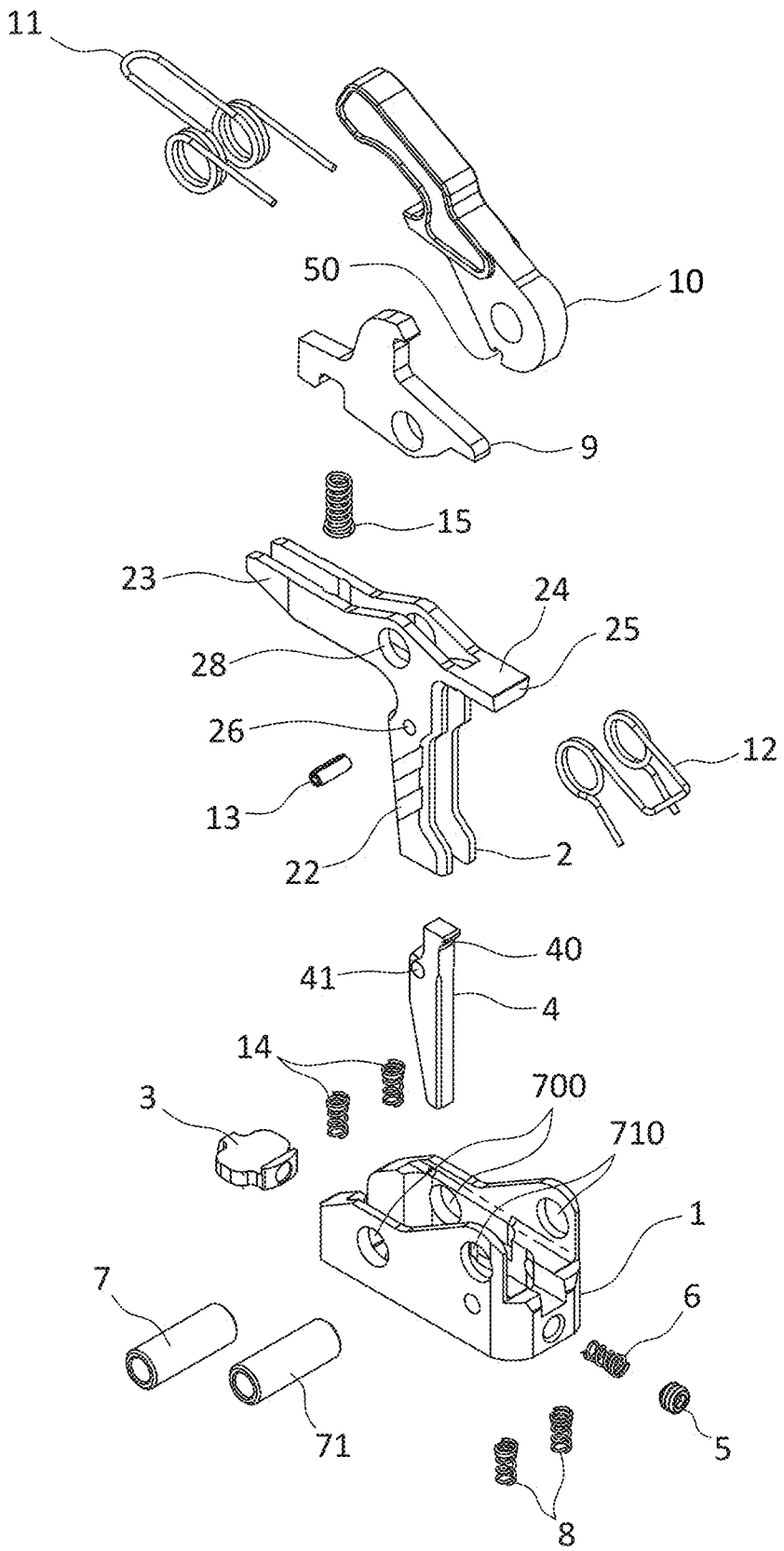
FIG. 4 is an exploded view of various components of a drop-in trigger assembly comprising a fire-control system according to an embodiment of the invention.

The disclosed fire control system comprises a primary trigger, a secondary trigger, and a trigger stop having a stop riser, wherein the stop riser limits the ability to break the trigger sear interface between the primary trigger and the firearm's hammer. A primary objective of the system is to reduce the risk of unintentional discharge of a firearm having a semi-automatic hammer-fired mechanism. Firearms that have semi-automatic hammer-fired mechanisms may include pistols and rifles.

Firearms having semi-automatic hammer-fired mechanisms are commonly used by military and law enforcement personnel in the line of duty, as well as by civilians for recreational and competition uses, e.g. hunting and target shooting. Regardless of the user or reason for use, these firearms may present a risk of being unintentionally discharged as a result of the trigger being contacted by equipment that the user is carrying or wearing, or as a result of contact with something in the environment, such as a tree branch. For example, the disclosed system is intended to avoid unintended discharge caused by a strap from the user's gear becoming caught or wrapped around, and inadvertently pulling, the trigger.

Further, in a preferred embodiment, the disclosed fire-control system reduces the chance of unintentional discharge, without compromising the user's ability to reliably operate the firearm in times of intentional use.

The disclosed fire-control system comprises a primary trigger, a secondary trigger and a trigger stop. The secondary trigger is pivotally connected to the primary trigger. The secondary trigger is in direct or indirect contact with the trigger stop. The trigger stop moves in and out of a predetermined position by pulling the secondary trigger.

In a preferred embodiment, the trigger stop comprises a stop riser. The stop riser may comprise a higher profile (e.g., raised or elevated) portion of the stop riser. For example, the stop riser may comprise an upwardly projecting ledge or lip on the trigger stop. The trigger stop and stop riser may be a unitary body comprised of the same material, or may be comprised of two or more components seated or joined together.

If the secondary trigger is in its non-pulled position, the trigger sear interface between the primary trigger and the firearm's hammer is maintained, thereby decreasing the chance of unintentional discharge of the firearm.

When the trigger stop is in its predetermined initial position, it blocks motion between the sear faces which comprise the trigger sear interface (between the primary trigger and the firearm's hammer), thereby maintaining sear face contact. While sear face contact is maintained, the primary trigger requires a great deal of pressure to be pulled, and therefore is not easily pulled, thereby substantially avoiding unintentional pulling of the primary trigger and discharge of the firearm. Accordingly, in situations where a strap or other item inadvertently becomes tangled in the trigger of the fire control system of the invention, the trigger will not easily be actuated (pulled), thereby reducing the risk of unintentional discharge.

When the user pulls the secondary trigger, it results in moving the trigger stop from its predetermined initial position, thereby permitting the trigger sear interface between the primary trigger and the firearm's hammer to break and discharge the firearm.

In another embodiment of the disclosed system, the primary and secondary triggers may be pulled simultaneously (or the primary trigger is first pulled and then the secondary trigger is pulled) resulting in discharge, each referred to as "pull-through" mode. Operating in pull-through mode will require the use of more force, i.e. trigger pressure, than if the secondary trigger had been pulled prior to pulling of the primary trigger. "Pull-through" capability is particularly important to military and law enforcement users, so that they are still able to discharge their firearms without having first pulled the secondary trigger, in situations where same is needed. Because of this embodiment, it is not entirely possible to prevent all accidental discharge situations.

The accompanying drawing figures illustrate some non-limiting examples of the system according to the invention. The claimed invention is not limited to these specific illustrated examples.

FIGS. 1, 2, 3 and 4 are, respectively, perspective, right side, left side and exploded views of the exterior of an embodiment of the fire-control system and components, as follows:

- Housing 1, within which the following components are seated either partially or completely, and having at least two sets of apertures 700, 710 for receiving bushing 7 and bushing 71:
- Primary trigger 2, having
  - a lower portion 22,
  - a rearward portion 23,
  - a forward portion 24,
  - a leading edge 25;
  - an aperture 26 for receiving a pin coil spring 13;
  - a relief cut or channel 27 in the lower portion 22 for receiving a secondary trigger 4; and
  - an aperture 28 for receiving a bushing 7;
- Secondary trigger 4 having
  - a projection 40,
  - an aperture 41 for receiving pin coil spring 13;
- Coil pin spring 13 around which primary trigger 2 and secondary trigger 4 pivot;
- Trigger stop 3 having
  - a proximal end 31,
  - a distal end 32,
  - a top surface 33,
  - a stop riser 34 on a portion of surface 33 near distal end 32,
  - a stop face 35 on stop riser 34,
  - a bottom surface 36,
  - a front surface 37,
  - a recess 38 on the front surface 37 for receiving compression spring 6 against which trigger stop 3 is biased, and
  - a back surface 39;
- Trigger spring 12;
- Set screw 5 for containing compression spring 6 to housing 1;
- Compression spring 6 which applies force to return trigger stop 3 to the predetermined initial position upon each release of the secondary trigger 4; similar compression springs 8, 14 are also used in multiple locations for tensioning housing 1 in the installed position in a firearm receiver;
- Disconnect 9;
- Hammer 10 having
  - a notch/recess 50;
- Bushing 7 that traverses through apertures 700 in side walls of housing 1, through apertures 28 in the primary trigger 2, through the coiled portion of trigger spring 12, and upon which disconnect 9 is seated;
- Bushing 71 that traverses through apertures 710 in side walls of housing 1 and through the coiled portion of hammer spring 11, and upon which hammer 10 is seated;
- Trigger sear interface 51; and
- Compression spring 15 for seating the disconnect 9.

In the disclosed fire-control system, the primary and secondary triggers 2, 4 are pivotally connected to one another via a pin 13. The primary and secondary triggers are pivotable with respect to one another; in other words, secondary trigger 4 is pivotable on pin 13 without resulting in pivoting of primary trigger 2. Primary and secondary triggers are rotatably mounted within the housing 1.

The primary trigger 2 is approximately t-shaped, comprising lower portion 22, rearward portion 23 and forward portion 24. The lower portion 22 is intended to be pulled by a user's finger, and includes a relief cut or channel 27 to allow the inset and outset of the secondary trigger 4. "Inset" of the secondary trigger occurs when the secondary trigger is pulled, and "outset" is the position of the secondary trigger prior to pulling or after it is reset. The primary trigger and secondary trigger pivot around a pin within the fire-control assembly. A trigger stop that is contained within the assembly is able to move in and out of a predetermined position by actuating or pulling the secondary trigger.

Figure 8A:
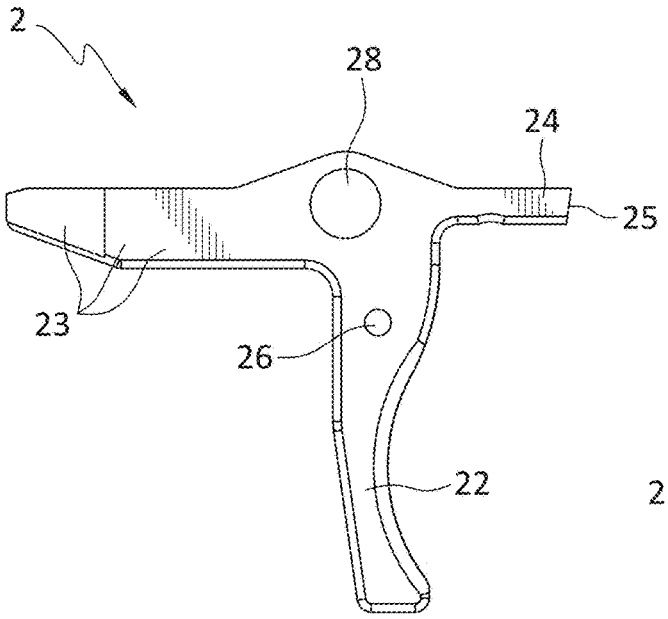
FIGS. 8A, 8B and 8C are, respectively, side, rear and front views of an example of a primary trigger from an embodiment of the fire-control system according to an embodiment of the invention.
Figure 8B:
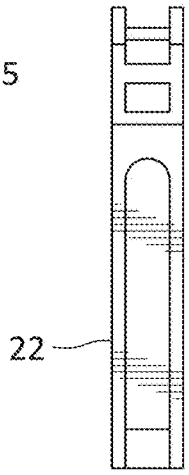
Figure 8C:
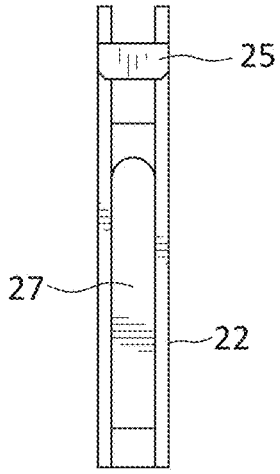
Figure 9A:
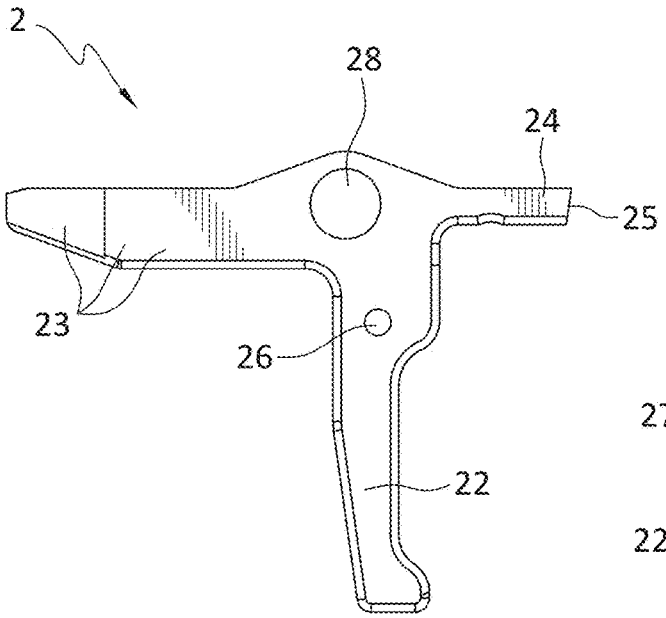
FIGS. 9A, 9B and 9C are, respectively, side, rear and front views of another example of a primary trigger from yet another embodiment of the fire-control system according to an embodiment of the invention.
Figure 9B:
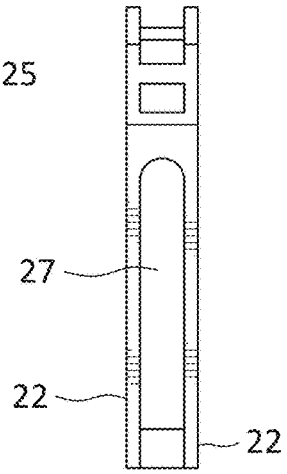
Figure 9C:
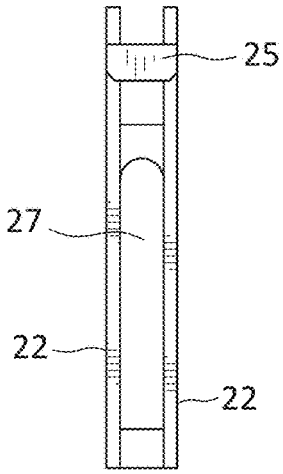
Figure 10A:
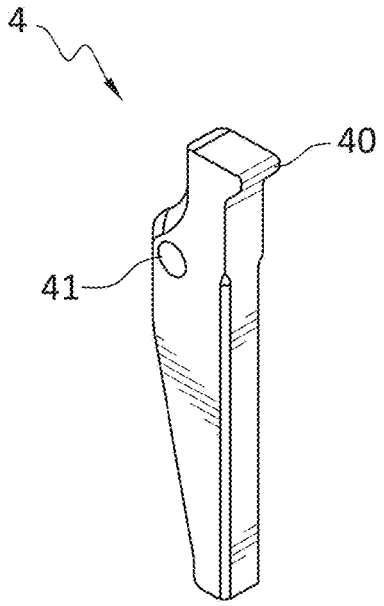
FIGS. 10A, 10B, 10C, 10D and 10E are, respectively, perspective, side, front, bottom and top views of an example of a secondary trigger from an embodiment of the fire-control system according to an embodiment of the invention.
Figure 10B:
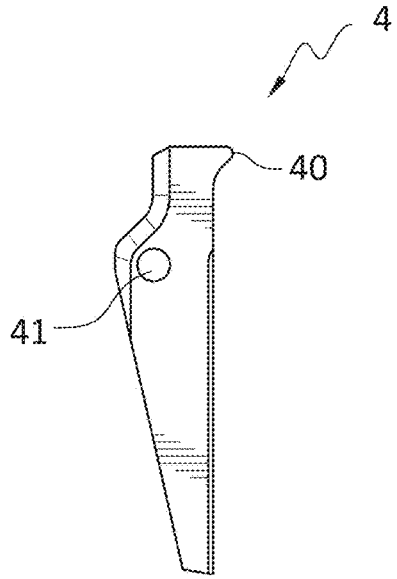
Figure 10C:
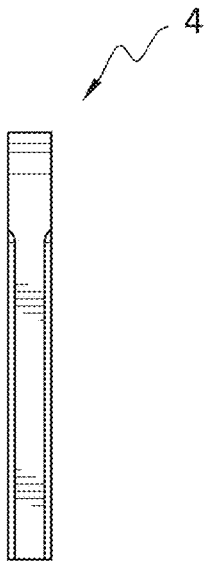
Figure 10D:
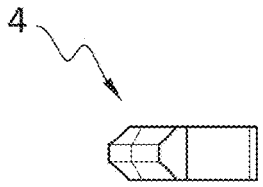
Figure 10E:
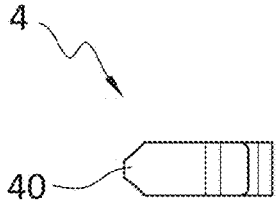
Figure 11A:
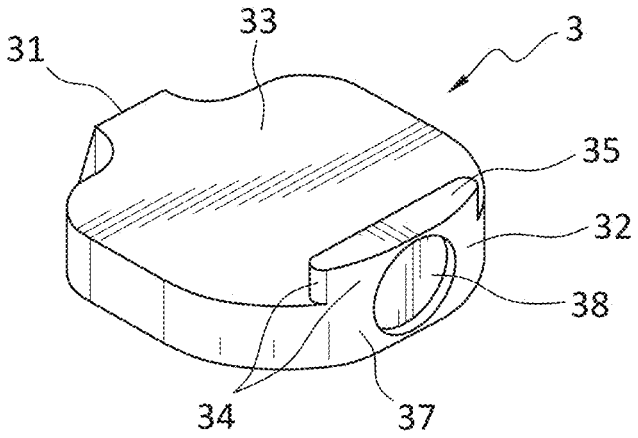
FIGS. 11A, 11B, 11C and 11D are, respectively, perspective, right side, left side and front views of a trigger stop from an embodiment of the fire-control system according to an embodiment of the invention.
Figure 11B:
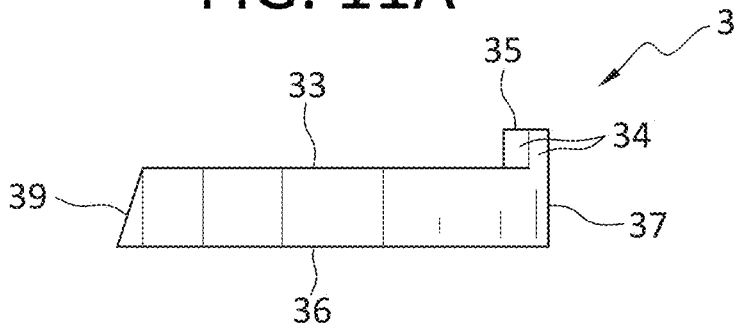
Figure 11C:
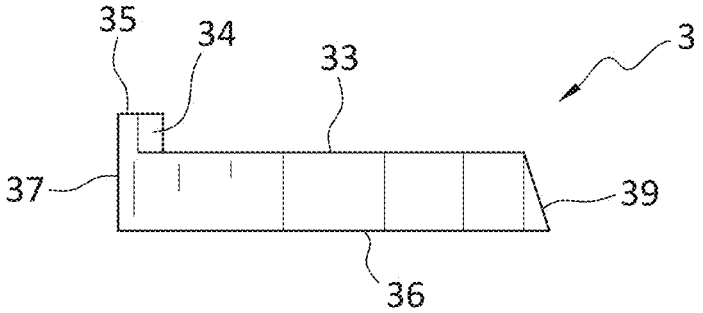
Figure 11D:
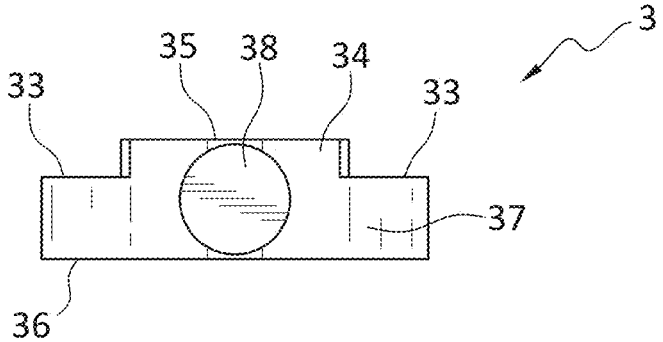

FIGS. 8A-8C show an embodiment of primary trigger 2. FIGS. 9A-9C show an alternative embodiment of primary trigger 2. Other embodiments of primary trigger 2 that may have different shapes than illustrated are within the scope of the disclosure, provided that they function as described herein.

FIGS. 10A-10E show an embodiment of secondary trigger 4. As with primary trigger 2, the shape and/or dimensions of secondary trigger 4 may vary from that shown in the drawings, provided that it functions as described herein. The upper portion of secondary trigger 4 has a projection 40, which communicates with trigger stop 3. In a preferred embodiment, projection 40 of secondary trigger 4 is in direct contact with the proximal end of trigger stop 3. In other embodiments, they may be in indirect contact, with other components between or connecting secondary trigger 4 to trigger stop 3.

Detailed views of a preferred embodiment of trigger stop 3 are shown in FIGS. 11A-11D. In a preferred embodiment, trigger stop 3 is a unitary body formed by molding and/or machining. Trigger stop 3 has a proximal end 31, a distal end 32, a top surface 33 and a bottom surface 36. A portion of top surface 33 located at distal end 32 has an upwardly projecting ledge or lip referred to herein as a stop riser 34. Also located within distal end 32 is a recess or depression 38 for receiving a first end portion of a compression spring 6. Compression spring 6 has a second end portion that is biased against a set screw 5 secured to the trigger assembly's housing 1.

Trigger stop 3 is able to move in and out of a predetermined position by use of the secondary trigger and a spring like mechanism. Pulling (i.e., actuating) the secondary trigger permits the trigger sear interface between the primary trigger and the firearm's hammer to be broken. If the secondary trigger is in its non-pulled position, it limits the user's ability to break the trigger sear interface.

In one nonlimiting embodiment, when the secondary trigger 4 is pulled, it causes the trigger stop 3 to move in a substantially lateral direction away from the user, thereby providing an expanded space within which the primary trigger 2 can downwardly rotate into. In other words, when the secondary trigger 4 is pulled, it provides the front end of the primary trigger with a pathway within which to drop downward (into the space or gap on the top of the trigger stop 3).

Still other embodiments of the enhanced fire-control system according to the invention but which are not illustrated in the accompanying drawing figures include structures wherein the primary trigger rotates or moves in a direction other than downward.

In the cocked position, the hammer sear remains in position being held by a sear face stop positioned in a manner to impede the motion of the sear so as to not allow the trigger sear faces to break contact. The secondary trigger 4 interfaces with trigger stop 3 in a manner to move the stop in and out of position when the secondary trigger 4 is pulled independently of the pulling of the primary trigger 2.

Pull-through mode occurs as follows: if the primary trigger 2 is pulled without pulling the secondary trigger 4, the trigger stop 3 will be an impediment and will resist breaking the trigger sear interface, thereby resisting discharge of the firearm. If the secondary trigger 4 and primary trigger 2 are pulled simultaneously, the trigger sear face breaks and the firearm discharges. If the primary trigger 2 is pulled first, and the secondary trigger 4 is pulled second, the trigger sear face breaks and the firearm discharges. In either of these two pull-through scenarios, the user will need to use greater force to pull the trigger than if instead the secondary trigger 4 was pulled followed by the primary trigger 2 being pulled.

If only the primary trigger 2 is pulled, i.e., without the secondary trigger being pulled before, after or simultaneously with it, the trigger sear face cannot break, and therefore the firearm cannot discharge.

In the pre-stage position, the secondary trigger 4 must be pulled prior to pulling primary trigger 2 in order to position the trigger stop 3 in a manner to permit the trigger sear faces to break contact. The primary trigger 2 can then be pulled thus causing the trigger sear faces to break contact moving the fire-control into a fired position. The cycle of the weapon will re-cock the hammer and be retained in an over-cocked position being held by a disconnect sear. The disconnect sear will release upon the release of the primary trigger, thus resetting the fire-control into the cocked position.

Figure 6:
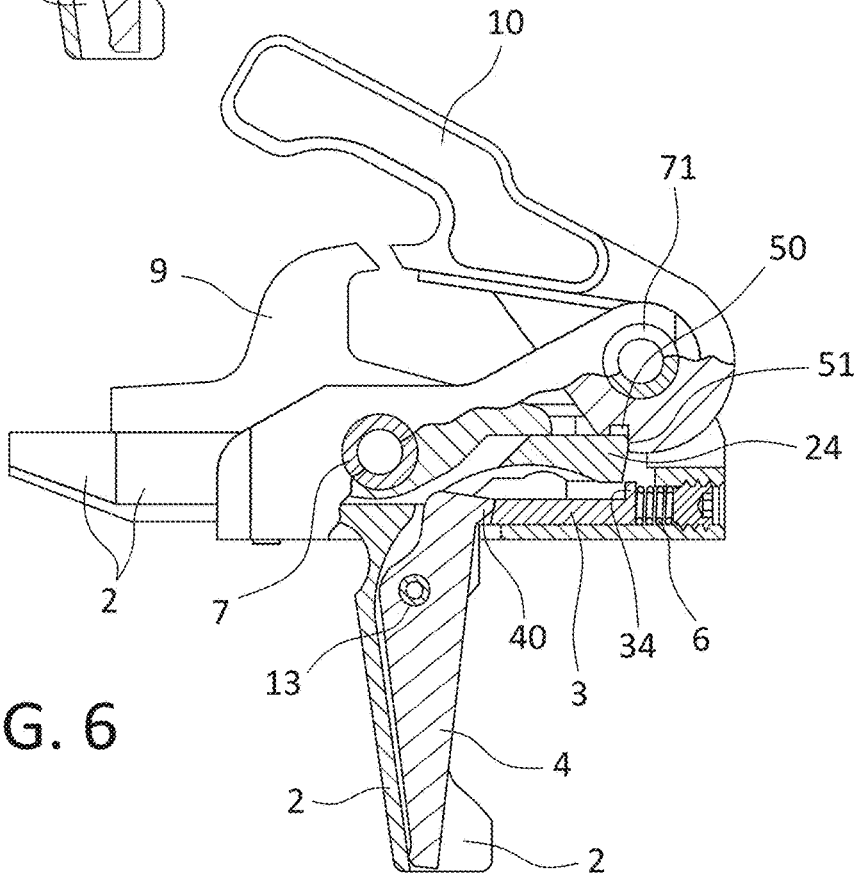
Figure 7:
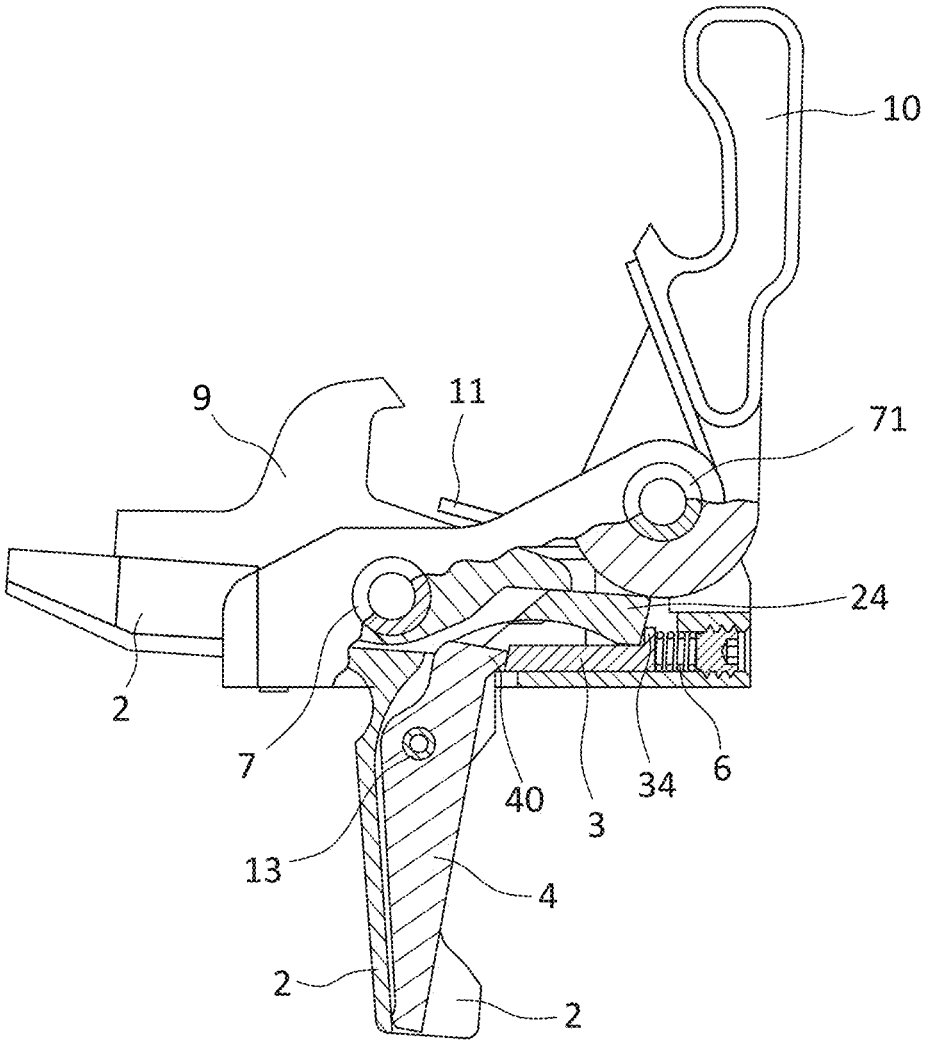

In one embodiment, when the secondary trigger 4 is pulled, it causes the trigger stop 3 to be displaced, wherein the trigger stop moves in a substantially linear direction away from the secondary trigger 4 and the user. As the trigger stop 3 moves, it applies force against compression spring 6 which is biased against an inner portion of housing 1. As illustrated in the drawing figures, especially FIGS. 5-7, the movement or displacement of trigger stop 3 that is caused by pulling secondary trigger 4 results in formation of a space or passage through which the front end 24 of the primary trigger 2 may drop downward into, thereby permitting the trigger sear interface between the primary trigger 1 and hammer 10 to break, resulting in discharge of the firearm.

Figure 5:
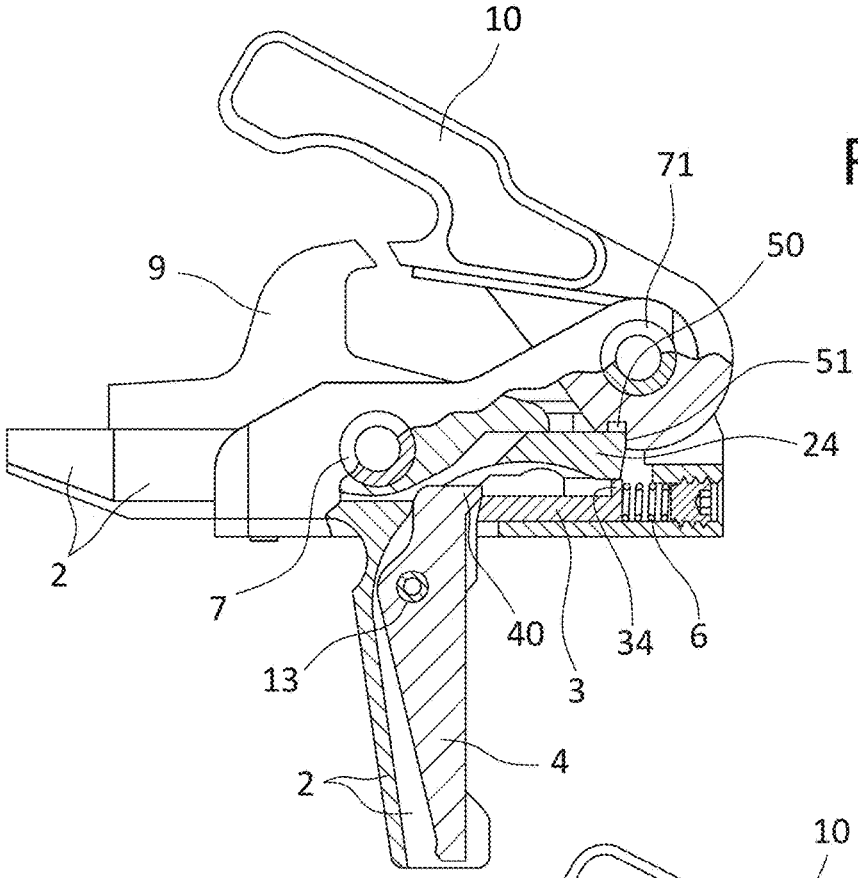
FIGS. 5, 6 and 7 are cross-sectional views of a drop-in trigger assembly comprising a fire-control system according to an embodiment of the invention, showing the assembly in the cocked, staged, and fired positions, respectively.

The trigger sear includes hammer 10 having a notch or relief cutout 50 which is releasably engaged by and biased against a portion of the top of the forward portion 24 of primary trigger 2. This renders the hammer 10 substantially unmovable in its cocked position whilst the secondary trigger 4 is in its resting, nonpulled position, as shown in FIG. 5.

If the secondary trigger 4 has not yet been pulled, a portion of the underside of the forward portion of primary trigger 2 rests on the stop face 35 of step riser 34 of trigger stop 3.

The disclosed enhanced fire-control system, for use in a firearm having a semi-automatic hammer-fired mechanism, comprises a primary trigger 2; a secondary trigger 4 pivotably connected to the primary trigger 2; and a trigger stop 3 having a stop riser 33, wherein the stop riser 33 limits breaking contact of a sear interface between the primary trigger 2 and the firearm's hammer unless the secondary trigger 4 is pulled. Preferably, primary trigger 2 has a channel to allow inset and outset of secondary trigger 4.

In the disclosed enhanced fire-control system, sear interface contact between the primary trigger and the firearm's hammer is maintained when the firearm is in a cocked or a staged position.

Further, in an embodiment of the disclosed enhanced fire-control system, a user by substantially simultaneously pulling the primary trigger 2 and the secondary trigger 4 will break contact of the sear interface between the primary trigger 2 and the firearm's hammer.

In yet another embodiment, pulling the primary trigger 2 without pulling the secondary trigger 4 will limit breaking contact of a sear interface between the primary trigger 2 and the firearm's hammer.

In still yet another embodiment of the disclosed enhanced fire-control system, the primary trigger 2 has a forward portion 24 and stop riser 33 that limits downward movement of the forward portion, to limit breaking contact of a sear interface between the primary trigger 2 and the firearm's hammer unless the secondary trigger 4 is pulled.

In another embodiment of the enhanced fire-control system, an upper portion of the secondary trigger 4 has a projection 40 that exerts force on back surface 39 of trigger stop 3, and trigger stop 3 moves in a substantially lateral direction when secondary trigger 4 is pulled, providing a pathway for a forward portion 24 of primary trigger 2 to travel when primary trigger 2 is pulled.

Yet another embodiment of the disclosed enhanced fire-control system is for a long gun firearm having a semi-automatic hammer-fired mechanism, and comprises a primary trigger 2 having a lower portion 22, a rearward portion 23 and a forward portion 24; a secondary trigger 4 pivotably connected to the primary trigger 2; and a trigger stop 3 having a stop riser 33, wherein an upper portion of the secondary trigger 4 has a projection 40 that exerts force on back surface 39 of trigger stop 3, wherein the stop riser 33 limits breaking contact of a sear interface between the primary trigger 2 and the firearm's hammer unless the secondary trigger 4 is pulled.

What is claimed:

1. An enhanced fire-control system, for use in a firearm having a semi-automatic hammer-fired mechanism, comprising:

a primary trigger 2;

a secondary trigger 4 pivotably connected to the primary trigger 2; and a trigger stop 3 located substantially externally to the primary trigger 2 and the secondary trigger 4 and having a stop riser 34;

wherein secondary trigger 4 actuates force on trigger stop 3 when secondary trigger 4 is pulled, and wherein the stop riser 34 limits breaking of a sear interface between the primary trigger 2 and the firearm's hammer unless the secondary trigger 4 is pulled.

2. The enhanced fire-control system of claim 1, wherein primary trigger 2 has a channel to allow inset and outset of the secondary trigger 4.

3. The enhanced fire-control system of claim 1, wherein the sear interface between the primary trigger and the firearm's hammer is maintained when the firearm is in a cocked or a staged position.

4. The enhanced fire-control system of claim 1, wherein pulling the secondary trigger 4 followed by pulling the primary trigger 2 breaks the sear interface.

5. The enhanced fire-control system of claim 1, wherein substantially simultaneously pulling the primary trigger 2 and the secondary trigger 4 breaks the sear interface.

6. The enhanced fire-control system of claim 1, wherein pulling the primary trigger 2 followed by pulling the secondary trigger 4 limits breaking the sear interface.

7. The enhanced fire-control system of claim 6, whereby limiting breaking the sear interface reduces risk of unintentional discharge of a firearm.

8. The enhanced fire-control system of claim 1, wherein an upper portion of the secondary trigger 4 has a projection 40 that exerts force on back surface 39 of trigger stop 3, and trigger stop 3 moves in a substantially lateral direction when secondary trigger 4 is pulled, permitting breaking of a sear interface between the primary trigger 2 and the firearm's hammer.

9. The enhanced fire-control system of claim 1, wherein the primary trigger 2 has a forward portion 24 and stop riser 34 limits movement of the forward portion, to limit breaking contact of a sear interface between the primary trigger 2 and the firearm's hammer unless the secondary trigger 4 is pulled.

10. The enhanced fire-control system of claim 9, wherein the stop riser 34 limits downward movement of the forward portion 24 of the primary trigger 2.

11. An enhanced fire-control system, for a long gun firearm having a semi-automatic hammer-fired mechanism, comprising:

a primary trigger 2 having a lower portion 22, a rearward portion 23 and a forward portion 24;

a secondary trigger 4 pivotably connected to the primary trigger 2; and a trigger stop 3 located substantially externally to the primary trigger 2 and the secondary trigger 4 and having a stop riser 34;

wherein an upper portion of the secondary trigger 4 has a projection 40 that actuates force on the trigger stop 3 when the secondary trigger 4 is pulled, and, wherein the stop riser 34 limits breaking a sear interface between the primary trigger 2 and the firearm's hammer unless the secondary trigger 4 is pulled.

* * * * *